US006804981B1

(12) United States Patent
Maier

(10) Patent No.: US 6,804,981 B1
(45) Date of Patent: Oct. 19, 2004

(54) FLANGING DEVICE FOR PRE-FLANGING AND FLANGING OF COMPONENTS

(75) Inventor: Josef Maier, Wadern-Lockweiler (DE)

(73) Assignee: Thyssenkrupp Technologies AG, Essen (DE)

( * ) Notice: Subject to any disclaimer, the term of this patent is extended or adjusted under 35 U.S.C. 154(b) by 119 days.

(21) Appl. No.: 09/979,918

(22) PCT Filed: Aug. 9, 2000

(86) PCT No.: PCT/EP00/07724

§ 371 (c)(1),
(2), (4) Date: Nov. 26, 2001

(87) PCT Pub. No.: WO01/19547

PCT Pub. Date: Mar. 22, 2001

(30) Foreign Application Priority Data

Sep. 13, 1999 (DE) ..... 199 43 850
Nov. 20, 1999 (DE) ..... 199 55 981

(51) Int. Cl.[7] ..... B21D 39/02
(52) U.S. Cl. ..... 72/306; 29/243.58; 72/312
(58) Field of Search ..... 72/306, 307, 312, 72/450; 29/243.58, 243.5, 243.57

(56) References Cited

U.S. PATENT DOCUMENTS 3,143,095 A * 8/1964 Tribe ..... 29/243.58
5,005,398 A * 4/1991 Evans ..... 72/450
5,150,508 A 9/1992 St. Denis
5,272,903 A 12/1993 Evans

FOREIGN PATENT DOCUMENTS

| | | | | |
|---|---|---|---|---|
| DE | 44 18 684 | | 11/1995 | |
| DE | 197 47 292 | | 1/1999 | |
| FR | 1322218 A | * | 2/1963 | |
| JP | 57028634 A | * | 2/1982 | ..... B21D/19/08 |
| JP | 57124524 A | * | 8/1982 | ..... B21D/19/14 |
| JP | 05228557 A | * | 9/1993 | ..... B21D/39/02 |

* cited by examiner

*Primary Examiner*—Lowell A. Larson
(74) *Attorney, Agent, or Firm*—McGlew and Tuttle, P.C.

(57) ABSTRACT

A hemming or flanging device is provided for the prehemming and finishing hemming of components with a first component having an upright standing flange before hemming and a second component with a flat edge area. The device includes a folding bed performing the hemming stroke with support surfaces for the components arranged to be approached at least in an edge area. At least one prefolding jaws movable into a prehemming position, with a flange contact surface arranged obliquely to the flange. At least one finishing folding jaw has contact surfaces arranged in parallel to the edge area. A finishing folding jaw slide moves the finishing folding jaw from an outside to an inside into a finishing hemming position. A prefolding jaw slide or a pivoting plate moves the prefolding jaw from the outside to the inside into the prehemming position and relative to the finishing folding jaw slide.

18 Claims, 7 Drawing Sheets

FLANGING DEVICE FOR PRE-FLANGING AND FLANGING OF COMPONENTS

Figure 1:
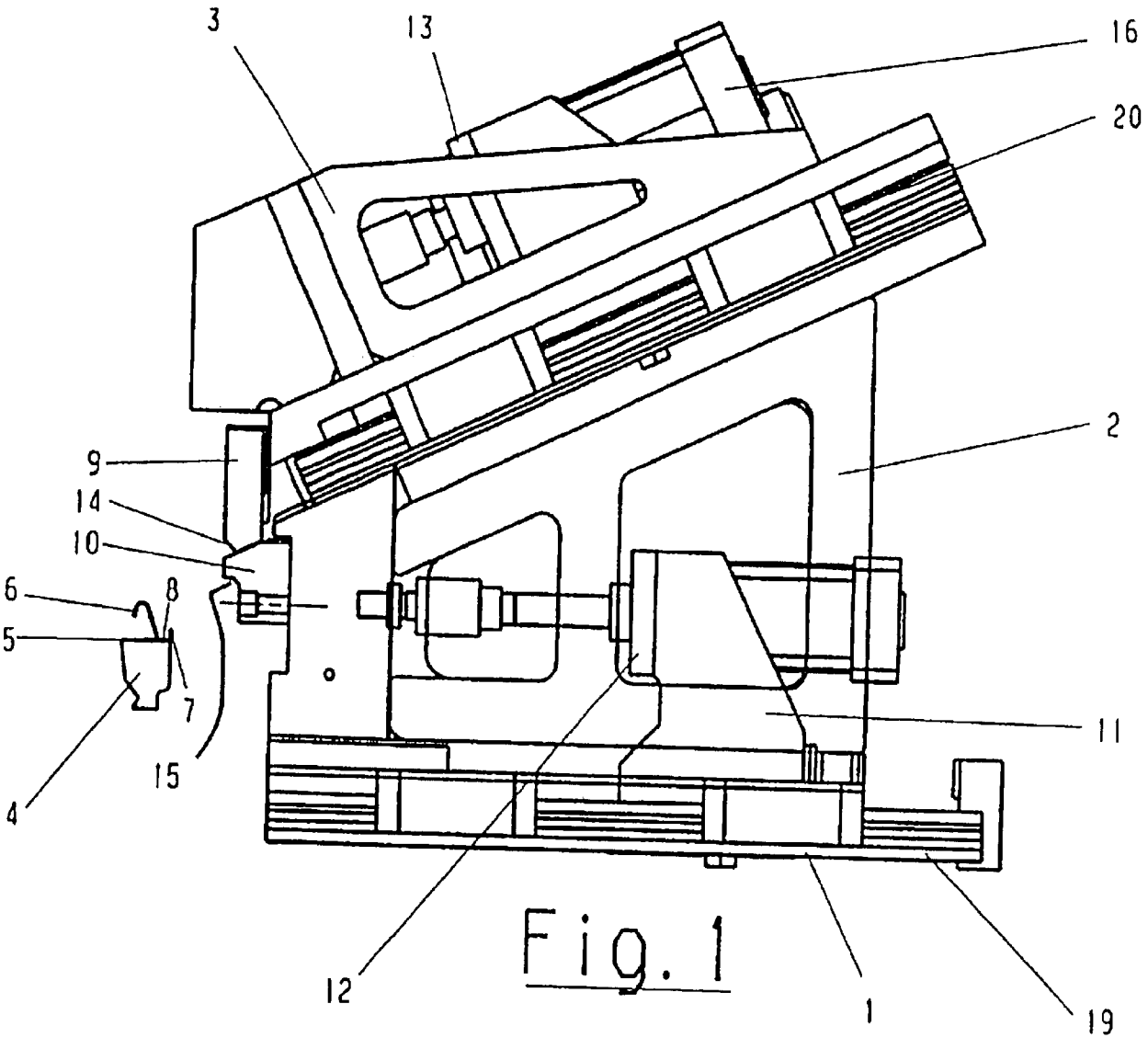

The present invention pertains to a hemming device according to the preamble of patent claims 1 and 2.

"Hemming" is defined as the positive-locking connection of two parts by folding over a flange. Especially an outer sheet metal and an inner sheet metal are connected to one another hereby in the manufacture of vehicle bodies.

For example, the following systems are available for the hemming of body parts:

1. Hemming tools which are used in presses and perform the prehemming or finishing hemming of the flange by a vertical movement of the upper part of the tool. Such a hemming process has been known from DE 44 18 684 A1, where a slide moves radially inwardly and subsequently again radially outwardly for the prehemming and a second hemming tool is displaced vertically by means of the press punch for the finishing hemming. Special efforts are needed for feeding and removing the components due to the arrangement of the press above the folding bed. Above all, the upper tool must perform a long stroke.

2. Hemming devices in which the hemming bed is stationary and the flange to be hemmed is bent over by hydraulically or electrically operated slides or mechanical rocker arm elements. The actuation and operation of the hemming slides and the rocker arm element are complicated (cf. DE 197 47 292 C1).

3. A hemming device of this class has been known from U.S. Pat. No. 5,150,508, in which the lower folding bed, on which the sheet metals to be connected are placed, performs a separate hemming stroke for the prehemming and the finishing hemming and presses in the process the flange to be folded one after another against the stationary prefolding jaws and finishing folding jaws. The prefolding and finishing folding jaws are arranged rigidly on a horizontally displaceable slide. The folding bed must be displaced vertically and the folding jaws horizontally for the prefolding and the finishing folding. The folding bed must then perform a long displacement travel between the prefolding operation and the finishing folding operation and the hemming stroke proper in the particular positions.

The basic object of the present invention is to propose a device of this class, in which the vertical movement of the folding bed is limited to a minimum and the prefolding and finishing folding jaws are brought into position by secure and simple movements.

To accomplish this object, it is proposed that the prefolding jaw is also displaceable from the outside to the inside into the prehemming position by means of a slide and relative to the slide of the finishing folding jaw.

As an alternative to the displaceability of the prefolding jaw, it is proposed according to the present invention that the prefolding jaw is fastened to a pivoting plate and can be pivoted from the outside to the inside into the prehemming position by actuating the pivoting plate, and that the pivoting plate can be locked with the prefolding jaw fastened to it in the prehemming position. Meaningful embodiments for this are shown in the subclaims 3 through 10.

Due to the fact that the folding jaws can be displaced according to the present invention on slides of their own possibly independently from one another into the hemming position above the folding bed for the prefolding and the finishing folding, the displacement travel of the folding bed can be considerably reduced. The prefolding and finishing folding jaws can be brought one after another into the same hemming position especially if the guide paths of the two slides are arranged at acute angles in relation to one another, so that a long adjustment movement of the folding bed between the prefolding and the finishing folding is not necessary. Consequently, the folding bed performs only the hemming stroke proper each time for the prefolding and the finishing folding, and this hemming stroke takes place at one and the same point. The same is also possible in the alternative embodiment, the combination of the pivotable prefolding jaw with the displaceable to finishing folding jaw.

It proved to be favorable to arrange the slide for prefolding or the pivoting plate on the slide for finishing folding or vice versa. In this so-called piggyback arrangement or slide-on-slide arrangement, the displacement travels for the individual slides are limited to a minimum. In addition, an especially compact design is possible. A spring actuated holding-down device, which fixes the two sheet metals on the surface of the folding bed already before the beginning of the prefolding and finishing holding operation, may be arranged on the upper slide, preferably the slide for the prefolding or on the pivoting plate.

It proved to be favorable in the alternative embodiment according to the present invention to mount the drives for the slide with the finishing folding jaw and the pivoting plate on a common bracket in an articulated manner, wherein the bracket itself is rigidly connected to the base. Moreover, the pivoting plate may be mounted on another bracket, which is likewise rigidly connected to the base or to the slide, in a rotatingly movable manner via an additional hinge.

The pivoting plate can be locked in the working position by a locking unit, which is brought into the locked position by a movement of the slide for the finishing folding with the existing drive unit being arranged on the slide for the finishing folding. However, the pivoting plate and the slide may also be coupled with one another such that the prefolding and finishing folding jaws can be forcibly moved one after another into the working position with a common drive unit. It proved to be favorable in this connection to arrange stops at the pivoting plate and the slide, which are brought into contact for locking the prefolding jaws. The pivoting plate can then be pivoted upwards by means of a connecting link guide present at the slide for the subsequent finishing folding. Only one drive unit is necessary here for the linear movement of the slide, because the pivoting plate is inevitably also actuated at the same time with the movement of the slide.

Figure 4:
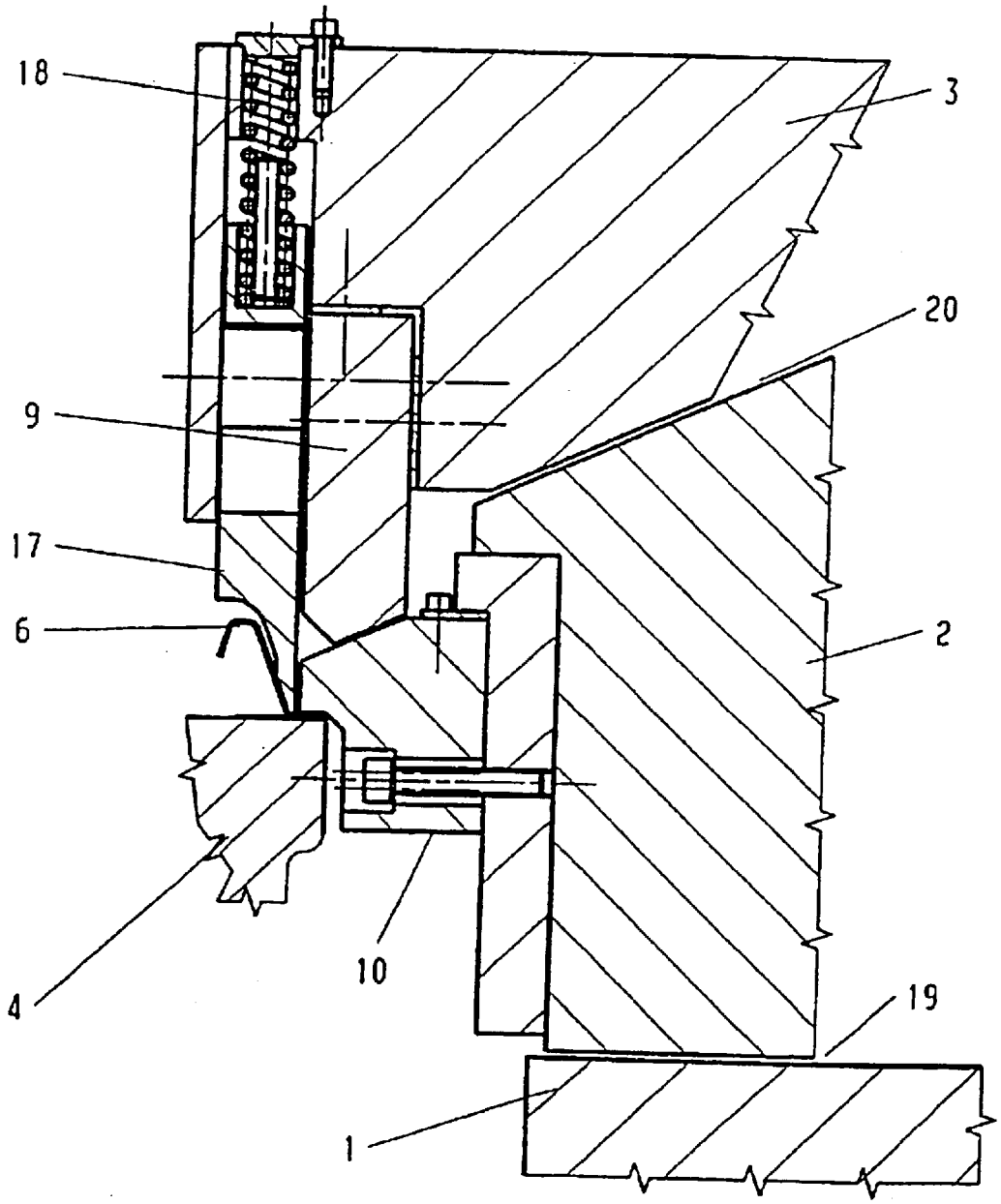
Figure 5:
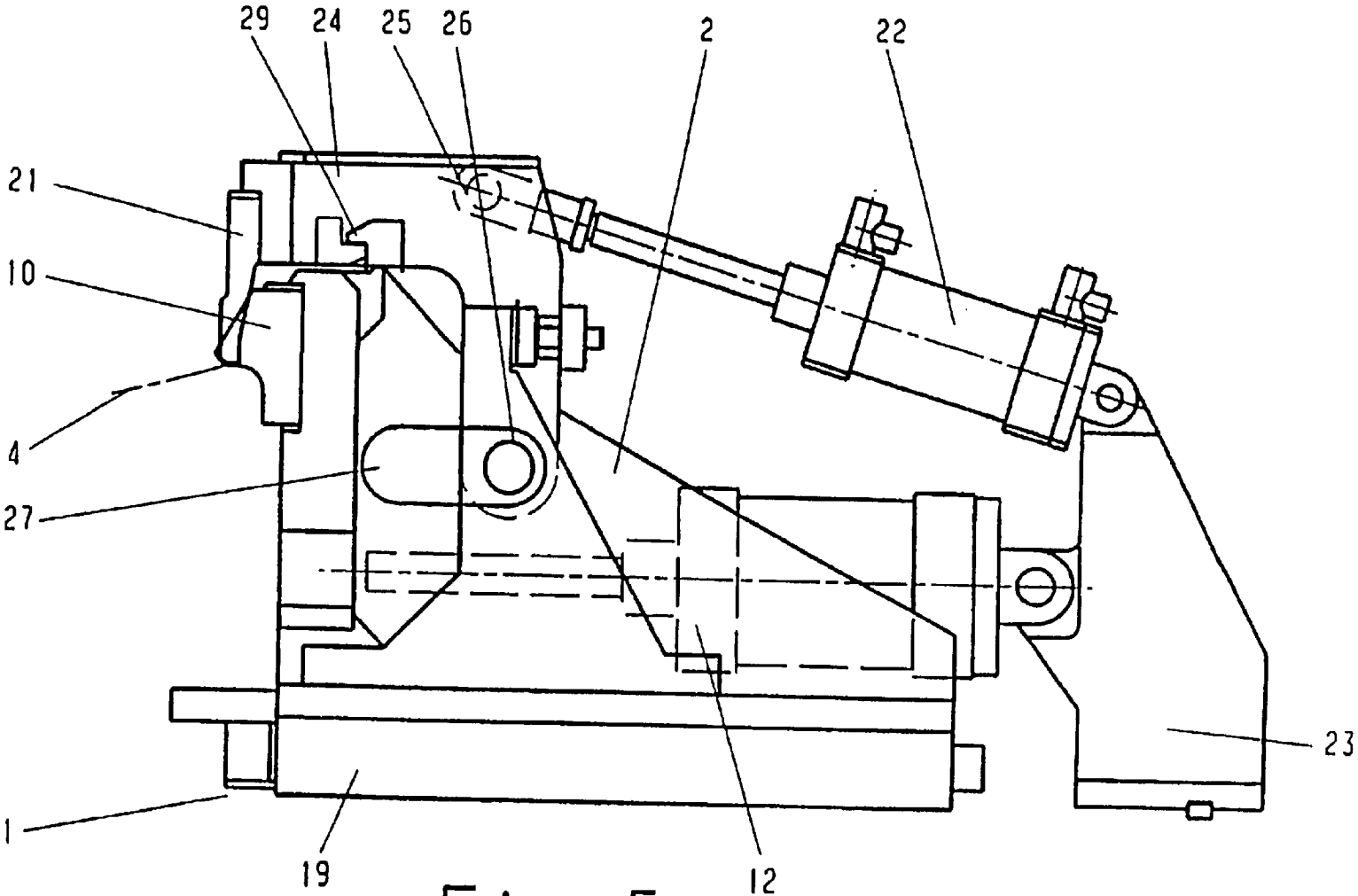
Figure 6:
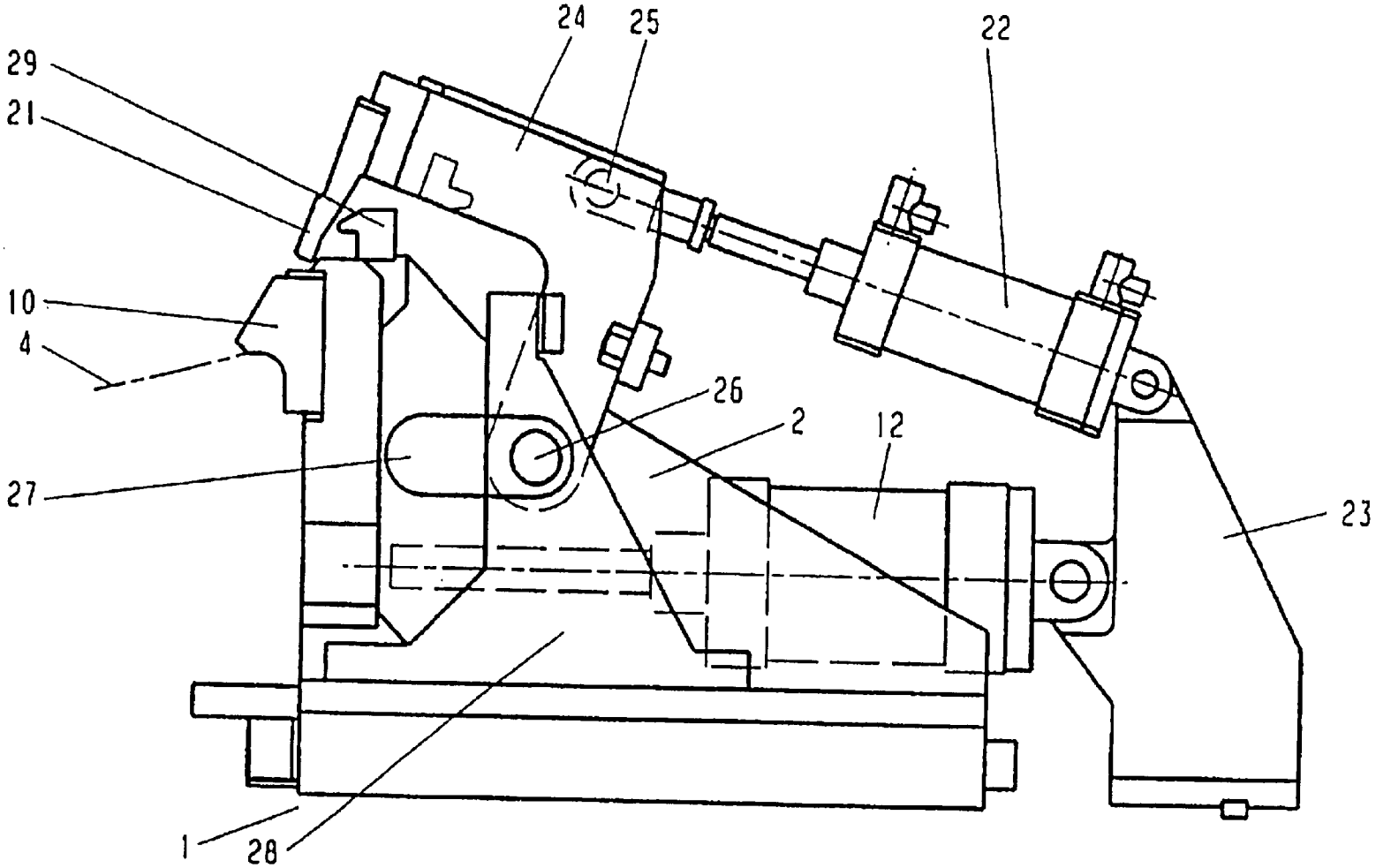
Figure 7:
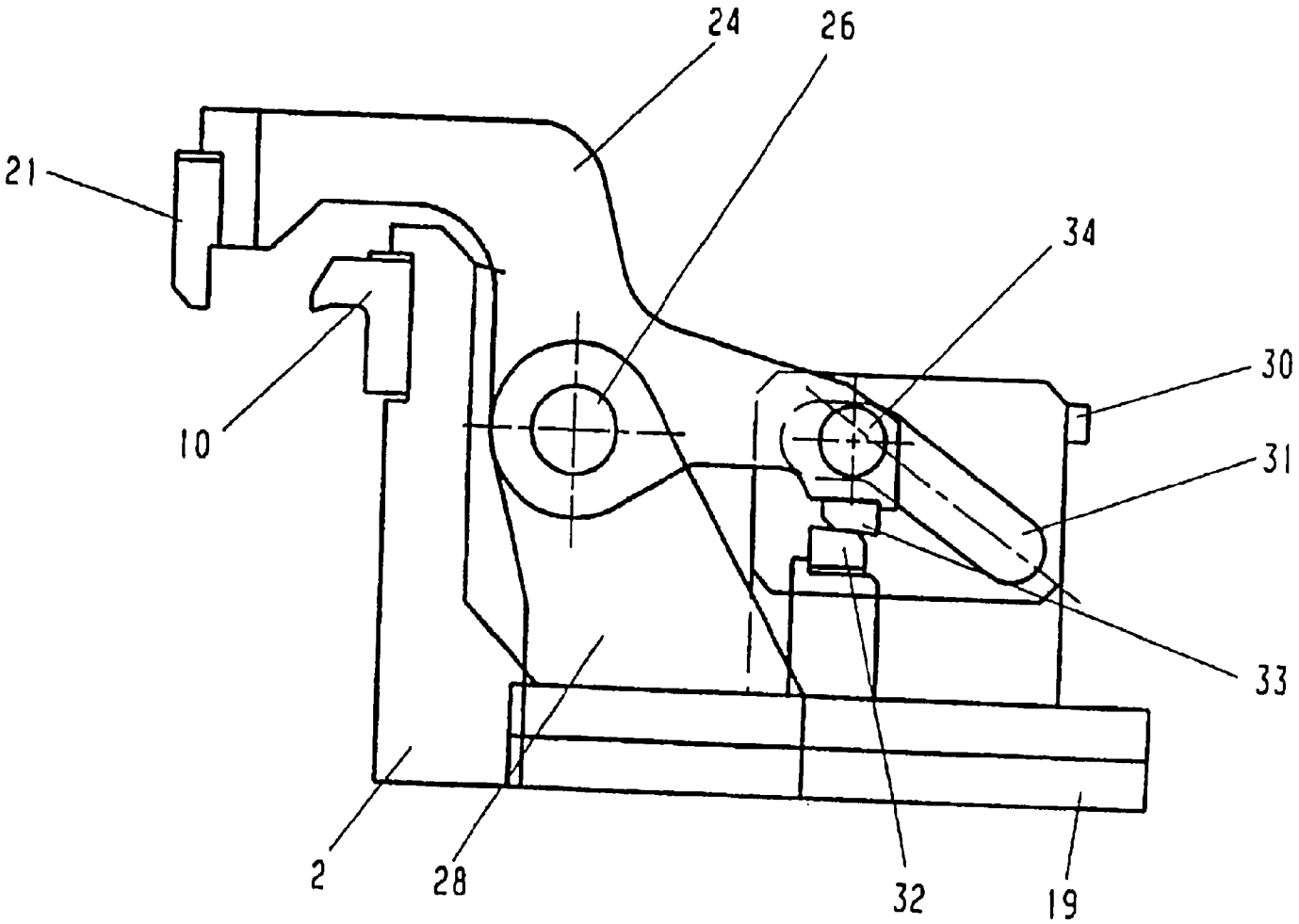

The present invention will be explained in greater detail on the basis of FIGS. 1 through 7 attached. In the drawings, FIG. 1 shows a side view of a detail of the slide-on-slide arrangement, FIG. 2 shows a sectional view for FIG. 1 in the so-called zero position, FIG. 3 shows a corresponding sectional view in the prefolding position, FIG. 4 shows a sectional view in the finishing folding position, FIG. 5 shows a side view of a detail of the combination of the pivoting plate and the slide in the prefolding position, FIG. 6 shows the pivoted-back position of the pivoting plate for FIG. 5, and FIG. 7 shows an embodiment for the actuation of the pivoting plate and the slide with a drive unit.

The figures show the outer edge of a folding bed 4 with the outer edges of the body sheets 5 and 6, which outer edges lie on the said outer edge. For hemming, e.g., an automobile door, a folding bed 4 is arranged under the entire door. The folding bed 4 with the sheets 5, 6 lying on it is raised with the hemming stroke and pressed one after another against the oblique contact surface 14 of the prefolding jaw 9 and against the horizontal contact surface 15 of the finishing folding jaw 10 for the two-step folding over of the upright flange 7 with the exception of the flat edge area 8. As is apparent from FIG. 1, the lower slide 2 is displaceable for the finishing folding on a base 1 on horizontal guide paths 19. The drive 12 for the slide 2 is supported on the frame 1 via the fastening 11. On the side facing the folding bed 4, the finishing folding jaw 10 is detachably fastened to the lower slide 2, e.g., by a screw connection. The upper slide 3 is displaceable on the slide 2 for prefolding on the guide paths 20 in the direction of the double arrow shown. The guide paths 20 are arranged at an acute angle, preferably at an angle of 25° in relation to the guide paths 19. The drive 13 for the slide 3 is supported on the slide 2 via the fastening 16. The prefolding jaw 9 is preferably fastened detachably to the slide 3.

Figure 2:
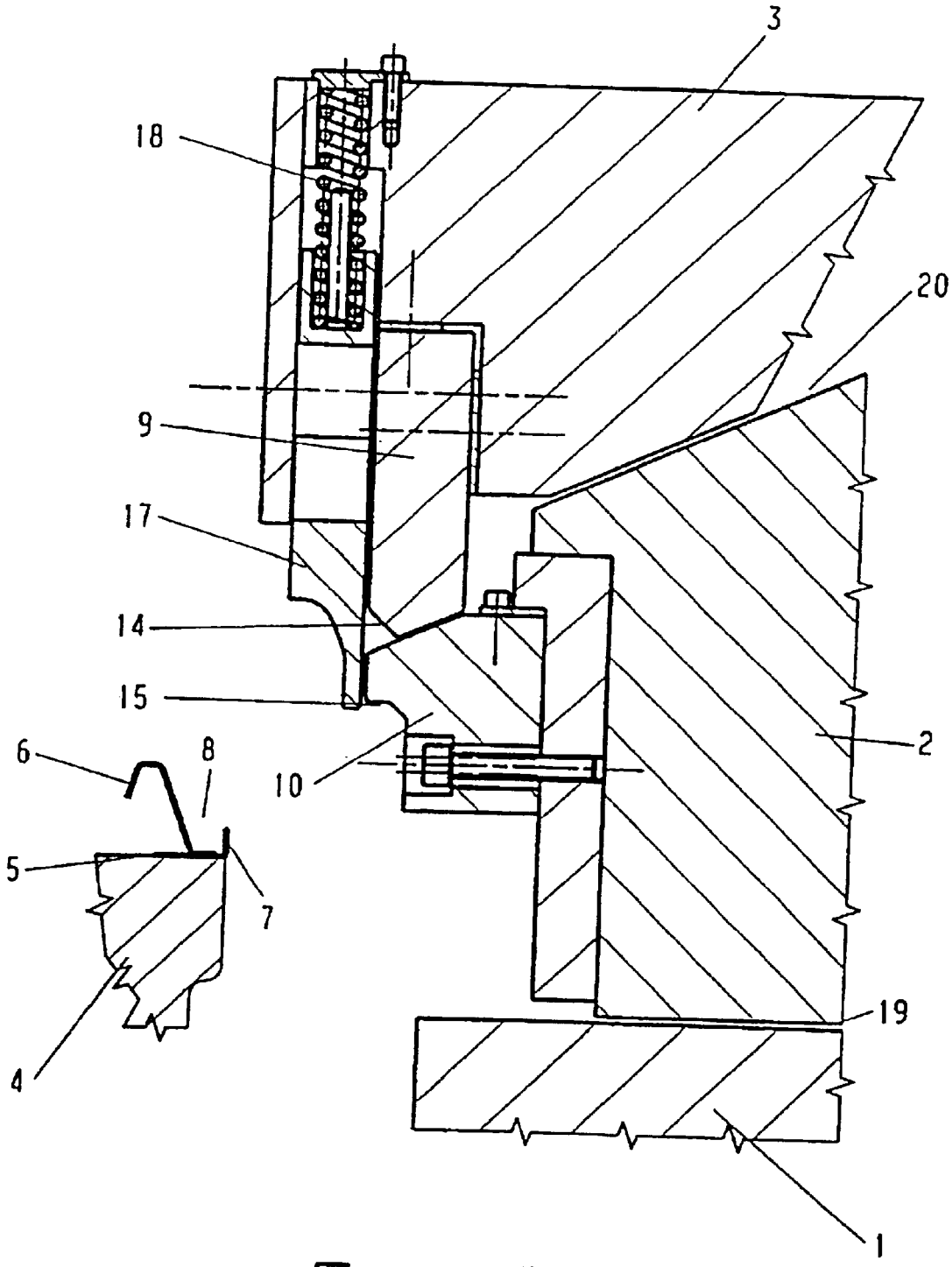

In the zero position shown in FIG. 2, the upper slide 3 with the prefolding jaw 9 and the lower slide 2 with the finishing folding jaw 10 are in the retracted position The folding bed 4 with the components 5 and 6 is lowered into the lower end position. The holding-down device 17 fastened to the upper slide 3 is held in the extended lower position by the spring 18 or in some other way.

Figure 3:
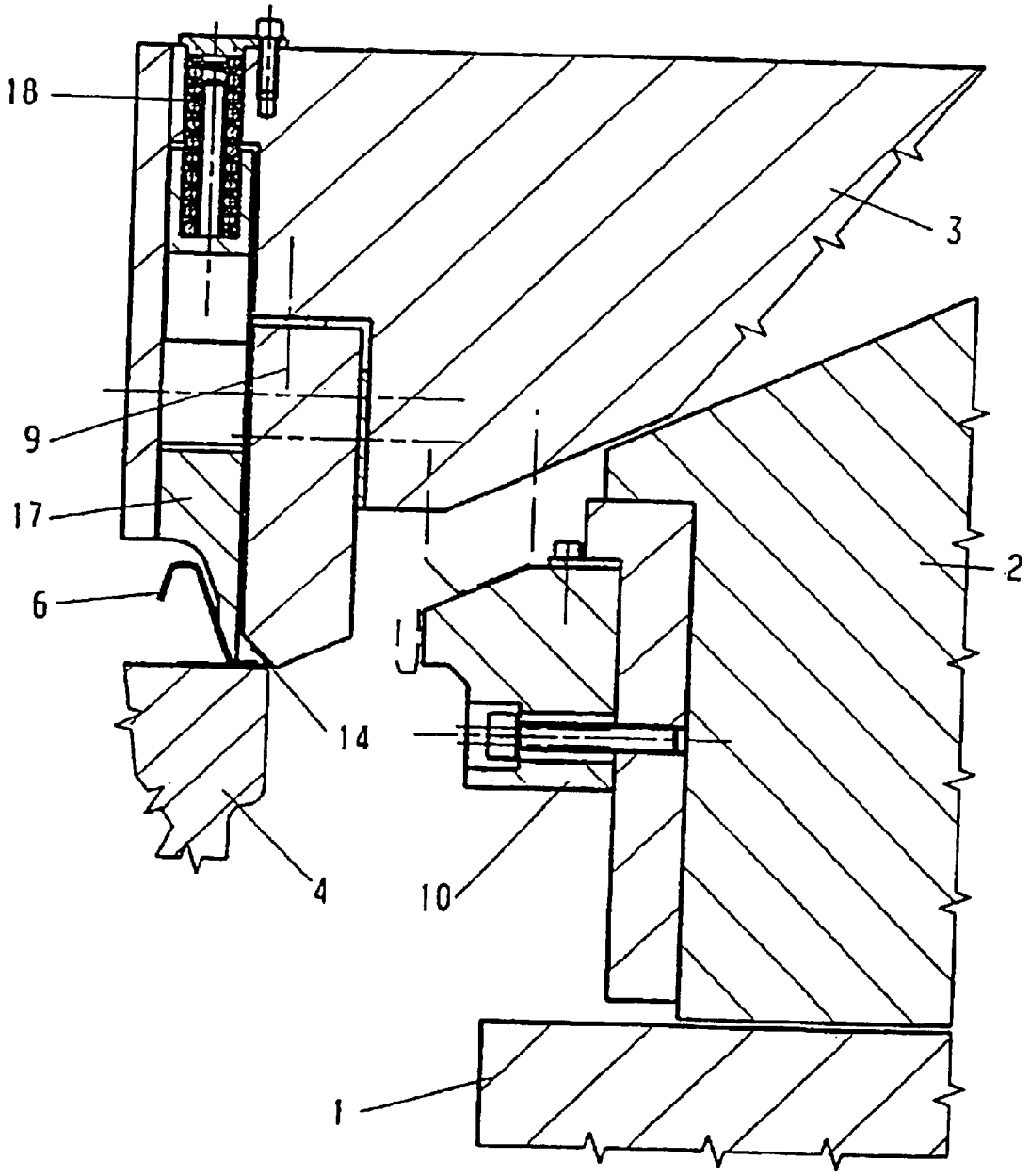

In the prefolding position according to FIG. 3, the slide 2 with the finishing jaw 10 is in the zero position. The slide 3 with the prefolding jaw 9 moves by about 50–60 mm at an angle of 25° in relation to the horizontal direction and can be locked by means of toggle levers, not shown, or in some other way. The holding-down device 17 is in the extended position under the force of a spring. The folding bed 4 moves upward into the hemming stroke, while the sheet 6 is fixed in its position by the holding-down device 17 by the force of a spring. The flange 7 is brought into an approximately 45° position during the hemming stroke by the oblique contact surface 14 of the prefolding jaw 9. After the conclusion of the prefolding operation, the folding bed 4 moves downward by the hemming stroke and the slide 3 returns into the zero position.

In the finishing folding position according to FIG. 4, the slide 3 with the prefolding jaw 9 is in the zero position. The slide 2 with the finishing folding jaw 10 moves to the stop. The holding-down device 17 is in the extended position under spring force. The folding bed 4 moves upward by the hemming stroke, while the sheet 6 is fixed in its position by the holding-down device 17 by spring force. After the conclusion of the folding operation, the folding bed 4 moves downward by the hemming stroke and the slides 2 and 3 return into the zero position.

The hemming device according to the present invention makes possible a substantial reduction of the vertical movements of the folding bed 4. This happens due to the fact that the prefolding and finishing jaws are brought one after another into the same folding position by means of a hydraulic, pneumatic or electric drive.

In the views in FIGS. 5 and 6, the prefolding jaw 21 is rigidly connected to the pivoting plate 24. The pivoting plate 24 is mounted on the bracket 28 in a rotatingly movable manner by means of the hinge 26, on the one hand, and, on the other hand, it is pivoted by means of the drive 22. The drive 22 is connected via the hinge 25 to the pivoting plate 24 and via another hinge to the bracket 23 which is fastened to the base 1. In the prefolding position according to FIG. 5, the pivoting plate 24 is secured by means of the locking mechanism 29. The locking mechanism 29 arranged rigidly on the slide 2 is moved to and fro together with the slide 2 by actuating the drive 12. According to FIG. 6, the bracket 28 is rigidly connected to the base 1. To make possible a relative movement between the slide 2 and the bracket 28, the slide 2 is provided with an elongated hole in the area of the hinge 26.

In the embodiment according to FIG. 7, only one drive unit 30, which moves the slide 2 linearly to and fro, is provided, contrary to the embodiment according to FIGS. 5 and 6, instead of the two drive units 12 and 22. To lock the prefolding jaw 21 in the prefolding position being shown, a lower stop 32 is fastened to the slide 2 and an upper stop 33 is fastened to the pivoting plate 24. When the slide 2 is moved to the left in the view by means of the drive unit 30 after the conclusion of the prefolding, the connecting link guide 31 arranged rigidly on the slide 2 is also moved at the same time, and the pivoting plate 24 fastened to the bracket 28 is moved with the roller 34 in the connecting link guide 31 such that the prefolding jaw 21 is pivoted upward in the process.

The process is essentially as follows in the "slide-on-slide" system:

1. Transfer of the components 5, 6 to the folding bed 4
2. The upper slide 3 with the prefolding jaw 9 moves forward into the folding position
3. The folding bed 4 with the components 5, 6 lying on it moves upward against the prefolding jaws 9 (prefolding)
4. The folding bed 4 with the prefolded flange 7 moves into the lowermost position
5. The upper slide 3 moves back
6. The lower slide 2 with the finishing folding jaw 10 moves forward into the folding position
7. The folding bed 4 with the components 5, 6 lying on it moves upward against the finishing folding jaws 10 (finishing folding)
8. The folding bed 4 with the finished folded component moves into the lowermost position
9. The lower slide 2 moves back
10. The finished folded component is removed.

The process is essentially as follows in the "pivoting plate and slide" system:

1. Transfer of the components 5, 6 to the folding bed 4
2. Pivoting of the prefolding jaws 21 into the prefolding position
3. Forward movement of the slide 2 to lock 29 the prefolding jaws 21 (see FIG. 5)
4. The folding bed 4 with the components 5, 6 lying on it moves upward against the prefolding jaws 21 (prefolding)
5. The folding bed 4 with the prefolded flange 7 moves into the lowermost position
6. The slide 2 moves back to unlock the prefolding jaws 21
7. Pivoting back of the pivoting plate 24 into the position according to FIG. 6
8. The slide 2 with the finishing folding jaws 10 moves forward into the finishing folding position
9. The folding bed 4 with the component lying on it moves upward against the finishing folding jaws 10 (finishing folding)
10. The folding bed 4 with the folded component moves into the lowermost position
11. The slide 2 moves back
12. The finished folded component is removed.

The process is as follows for the system according to FIG. 7:

1. The slide 2 is in the intermediate position, the pivoting plate 24 is pivoted up
2. The components are transferred to the folding bed 4
3. The slide 2 with the connecting link guide 31 moves back, the prefolding jaw 21 is pivoted in downward, automatic locking by the stops 32 and 33 (see FIG. 7)

4. The folding bed 4 with the components 5, 6 lying on it moves upward against the prefolding jaws 21 for prefolding
5. The folding bed 4 with the prefolded components moves into the lowermost position
6. The slide 2 moves forward until the prefolding jaw 10 is in the finishing folding position; pivoting up of the prefolding jaw 21 at the same time
7. The folding bed 4 with the prefolded component lying on it moves upward against the finishing folding jaws 10 for the finishing folding
8. The folding bed 4 with the finished folded component moves into the lowermost position
9. The slide 2 moves back into the intermediate position
10. The finished folded component is removed.

LIST OF REFERENCE NUMBERS

1 Base
2 Lower slide (for finishing folding)
3 Upper slide (for prefolding)
4 Folding bed
5 Lower component, body sheet
6 Upper component, body sheet
7 Upright flange of 5
8 Flat edge area of 6 (horizontal)
9 Prefolding jaw
10 Finishing folding jaw
11 Fastening for 12 to 1
12 Drive for 2
13 Drive for 3
14 Contact surface on 9 (oblique)
15 Contact surface on 10 (horizontal)
16 Fastening for 13 to 2
17 Holding down device
18 Spring
19 Horizontal guide path of 2
20 Oblique guide path of 3
21 Prefolding jaw
22 Drive for 21
23 Bracket for 12 and 22 on 1
24 Pivoting plate
25 Hinge between 22 and 24
26 Hinge between 24 and 28
27 Elongated hole in 2 for 26
28 Bracket on 1
29 Locking mechanism on 2 for 21
30 Common drive unit for 2 and 14
31 Connecting link guide (rigidly attached to 2)
32 Stop, lower (rigidly attached to 2)
33 Stop, upper (rigidly attached to 24)
34 Roller on 24

What is claimed is:

1. A hemming device for the prehemming and finishing hemming of components with a first component having an upright standing flange before hemming and second component with a flat edge area, the device comprising:

a base;

a folding bed performing the hemming stroke with respect to said base, said folding bed having support surfaces for the components arranged to be approached at least in an edge area;

at least one prefolding jaw movable into a prehemming position, with a flange contact surface arranged obliquely to said flange;

at least one finishing folding jaw having contact surfaces arranged in parallel to said edge area;

a finishing folding jaw slide moving said finishing folding jaw from an outside to an inside into a finishing hemming position; and a prefolding jaw slide displacing said prefolding jaw from the outside to the inside into the prehemming position and relative to said finishing folding jaw slide.

2. A hemming device in accordance with claim 1, wherein each slide is displaceable along respective guide paths extending at an acute angle in relation to one another.

3. A hemming device in accordance with claim 1, wherein said prefolding and finishing folding jaws have contact surfaces movable one after another into the hemming positions by means of the respective slides with said folding bed performing the same or essentially the same hemming stroke for the prehemming and the finishing hemming.

4. A hemming device in accordance with claim 1, wherein one of said finishing folding jaw slide and said prefolding jaw slide is arranged on the other of said finishing folding jaw slide and said prefolding jaw slide.

5. A hemming device in accordance with claim 1, further comprising a spring-actuated holding-down device, said prefolding jaw slide being arranged as an upper slide with said holding-down device arranged on said upper slide.

6. A hemming device for the prehemming and finishing hemming of components with a first component having an upright standing flange before hemming and a second component with a flat edge area, the device comprising:

a base;

a folding bed performing the hemming stroke with respect to said base, said folding bed having support surfaces for the components arranged to be approached at least in an edge area;

at least one prefolding jaw movable into a prehemming position, with a flange contact surface arranged obliquely to said flange;

at least one finishing folding jaw having contact surfaces arranged in parallel to said edge area;

a finishing folding jaw slide moving said finishing folding jaw from an outside to an inside into a finishing hemming position;

a pivoting plate, said prefolding jaw being fastened to said pivoting plate for pivoting from the outside to the inside into the prehemming position and lockable in the prehemming position.

7. A hemming device in accordance with claim 6, further comprising a finishing folding jaw slide drive and a bracket, said pivoting plate and said finishing folding jaw slide drive being mounted on said bracket in an articulated manner.

8. A hemming device in accordance with claim 6, further comprising a bracket, a hinge and a base, said pivoting plate being mounted in a rotatingly movable manner on said bracket, said bracket being rigidly connected to said base by said hinge.

9. A hemming device in accordance with claim 8, further comprising a common drive unit, wherein said pivoting plate and said finishing folding jaw slide are coupled with one another such that said prefolding and finishing folding jaws can be moved one after another into the prehemming and finishing hemming position via said common drive unit.

10. A hemming device in accordance with claim 8, wherein a pivoting plate stop and a finishing folding jaw slide stop touch each other for locking said prefolding jaws with said pivoting plate being pivoted up with said prefolding jaw around said hinge by displacing said finishing folding jaw slide into the finishing folding position via a connecting link guide associated with said finishing folding jaw slide.

11. A hemming device in accordance with claim 6, wherein said prefolding and finishing folding jaws have contact surfaces movable one after another into hemming positions respectively by said pivoting plate and said finishing folding jaw slide with said folding bed performing the same or essentially the same hemming stroke for the pre-hemming and the finishing hemming.

12. A hemming device in accordance with claim 6, wherein one of said said pivoting plate and said finishing folding jaw slide is arranged on the other of said pivoting plate and said finishing folding jaw slide.

13. A hemming device in accordance with claim 6, further comprising a spring-actuated holding-down device arranged on said pivoting plate.

14. A hemming device in accordance with claim 6, further comprising a bracket and a hinge, said pivoting plate being mounted in a rotatingly movable manner on said bracket, said bracket being rigidly connected to said finishing folding jaw slide by said hinge.

15. A hemming device for hemming a workpiece, the device comprising:

a base;

a folding bed supportable of the workpiece and movable with respect to said base in a hemming path between a hemming position and a retracted position;

a prefolding jaw movable with respect to said base into and out of said hemming path, said folding bed being movable toward said prefolding jaw arranged in said hemming path to pre-fold a flange of the workpiece;

a finishing jaw movable with respect to said base into and out of said hemming path, said folding bed being movable toward said finishing jaw arranged in said hemming path to finish fold the flange of the workpiece, said prefolding jaw and said finishing jaw being movable in separate directions angularly spaced from said hemming path.

16. A device in accordance with claim 15, wherein:

said prefolding jaw is movable Into said hemming position to pre-fold the flange of the workpiece;

said finishing jaw is also movable into said hemming position to finish fold the flange of the workpiece.

17. A device in accordance with claim 15, wherein:

said prefolding jaw includes a flange contact surface arranged obliquely to said flange;

said finishing jaw has a contact surface arranged substantially parallel to said folding bed supporting the flange of the workpiece.

18. A device in accordance with claim 15, wherein:

said prefolding jaw and said finishing jaw have one of a slide and pivot connection to said base;

one of said finishing jaw and said prefolding jaw is arranged on the other of said finishing jaw and said prefolding jaw.

* * * * *